US008042530B2

(12) United States Patent
Barnett

(10) Patent No.: US 8,042,530 B2
(45) Date of Patent: Oct. 25, 2011

(54) CROSSBOW WITH REMOVABLE PROD

(75) Inventor: David A. Barnett, Palm Harbor, FL (US)

(73) Assignee: Barnett Outdoors, LLC, Tarpon Springs, FL (US)

( * ) Notice: Subject to any disclaimer, the term of this patent is extended or adjusted under 35 U.S.C. 154(b) by 316 days.

(21) Appl. No.: 12/298,566

(22) PCT Filed: Apr. 26, 2007

(86) PCT No.: PCT/US2007/067523

§ 371 (c)(1), (2), (4) Date: Oct. 27, 2008

(87) PCT Pub. No.: WO2008/019177

PCT Pub. Date: Feb. 14, 2008

(65) Prior Publication Data

US 2009/0178658 A1 Jul. 16, 2009

(51) Int. Cl.
*F41B 5/12* (2006.01)

(52) U.S. Cl. ..... 124/25; 124/23.1; 124/25.5; 124/86

(58) Field of Classification Search ..... 124/23.1, 124/25, 25.5, 86

See application file for complete search history.

(56) References Cited

U.S. PATENT DOCUMENTS

| | | | | | |
|---|---|---|---|---|---|
| 214,791 | A * | 4/1879 | Randall | 124/25 |
| 2,609,810 | A * | 9/1952 | Gruner | 124/25 |
| 2,814,284 | A * | 11/1957 | Sileo | 124/25 |
| 2,842,114 | A * | 7/1958 | Duncan | 124/25 |
| 3,224,427 | A * | 12/1965 | Ronan | 124/25 |
| 4,294,222 | A * | 10/1981 | Pelsue | 124/25 |
| 4,545,358 | A * | 10/1985 | Collins | 124/88 |
| 4,565,182 | A * | 1/1986 | Barnett | 124/25 |
| 4,587,944 | A * | 5/1986 | Barnett | 124/25 |
| 4,594,994 | A * | 6/1986 | Williams | 124/25 |
| 4,649,892 | A * | 3/1987 | Bozek | 124/25 |
| 4,699,117 | A * | 10/1987 | Waiser | 124/25 |
| 4,711,228 | A * | 12/1987 | Gillespie | 124/25 |
| 4,716,880 | A * | 1/1988 | Adkins | 124/25 |
| 4,926,834 | A * | 5/1990 | Chauvin | 124/25 |
| 4,957,093 | A * | 9/1990 | Hamlett | 124/24.1 |
| 5,025,771 | A * | 6/1991 | Hanson | 124/25 |
| 5,522,373 | A * | 6/1996 | Barnett | 124/25 |
| 5,649,521 | A * | 7/1997 | King | 124/25 |
| 5,749,348 | A * | 5/1998 | Oviedo-Reyes | 124/25 |
| 5,823,172 | A * | 10/1998 | Suggitt | 124/25 |
| 5,881,704 | A * | 3/1999 | Andrews | 124/23.1 |
| 6,571,785 | B1 * | 6/2003 | Choma | 124/25 |
| 6,799,566 | B1 * | 10/2004 | Malucelli | 124/25 |
| 7,066,166 | B2 * | 6/2006 | Crites et al. | 124/25 |
| 7,204,242 | B2 * | 4/2007 | Dziekan | 124/25 |
| 7,624,724 | B2 * | 12/2009 | Bednar et al. | 124/25 |
| 2005/0279338 | A1 * | 12/2005 | Dziekan | 124/25 |

FOREIGN PATENT DOCUMENTS

| | | |
|---|---|---|
| CH | 112020 | 10/1925 |
| CH | 623129 | 5/1981 |

* cited by examiner

*Primary Examiner* — Gene Kim
*Assistant Examiner* — Alexander Niconovich
(74) *Attorney, Agent, or Firm* — Carlton Fields, P.A.; C. Douglas McDonald

(57) ABSTRACT

A crossbow (1) comprises α stock (2) having a detachable, pre-strunπg prod (10), with the stock (2) including a recess (20) for receiving the pre-strung prod (10), a latch (24) pivotally attached to the stock (2) adjacent the recess (20) for capturing the pre-strung prod (10) within the recess (20), and a fastener (22) for securing the pre-strung prod (10) to the stock (2).

8 Claims, 3 Drawing Sheets

CROSSBOW WITH REMOVABLE PROD

BACKGROUND ART

This invention relates to crossbows used by sportsmen and hunters and more specifically to a crossbow having a removable prod, or bow.

DISCLOSURE OF INVENTION

Conventional crossbows have a rigidly mounted prod, or bow, adjacent the front end of a stock that also incorporates a trigger mechanism for releasing a taut bow string so as to shoot a bolt therefrom. One disadvantage of the conventional crossbow lies in the configuration of the structure, with the prod mounted transversely to the stock and thus presenting a bulky configuration that is inconvenient to transport. This is a result of the conventional configuration having the prod affixed, more or less permanently, to the front portion of the stock without the intent for disassembly, apart from repair or replacement purposes. Thus, known crossbows are normally transported and stored between periods of use in an assembled configuration.

It is an object of the present invention to provide a crossbow that may quickly and easily be converted from a transport configuration, in which the separate pre-strung prod may be carried separately from, but adjacent and generally parallel to the stock, and a use configuration, with the prod mounted to the stock and extending transversely of the stock.

In accordance with the present invention there is provided a crossbow comprising a stock having a front portion and a rear portion and having a generally upwardly facing surface for carrying and supporting a bolt to be shot from the crossbow, and a generally downwardly facing portion having a recess adjacent the front of the stock on the generally downwardly facing surface, so that a pre-strung prod may be received within that recess, with the string of the prod extending over the upwardly facing stock surface. A releasable fastener for affixing the prod to the stock, and a suitable pivoting latch are provided to facilitate changing the prod between a mounted position and a dismounted position.

BRIEF DESCRIPTION OF DRAWINGS

Other features in the invention will become apparent from the attached drawings, which illustrated one preferred embodiment of the crossbow of this invention, wherein.

BEST MODE FOR CARRYING OUT THE INVENTION

Preferred Embodiment

Figure 1:
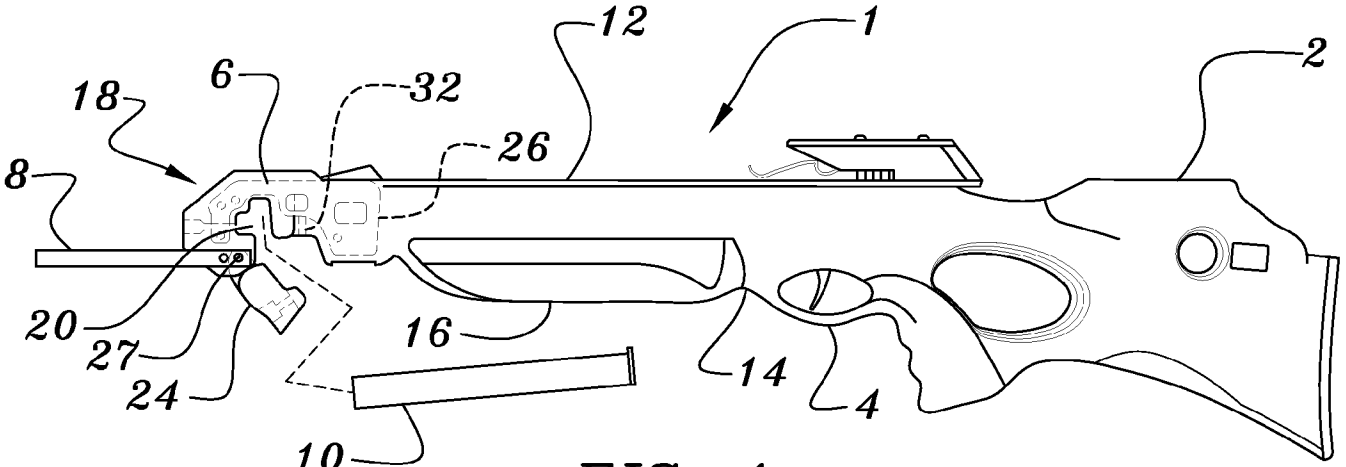
FIG. 1 is a side view of one preferred embodiment of the crossbow of this invention with the prod dismounted from the stock and the pivoting latch in the open position.

FIGS. 1-4 illustrate one preferred embodiment of the crossbow of this invention. This crossbow (1) comprises, generally, a stock (2) having a rearward portion for engaging a user's shoulder, a trigger mechanism (not shown) and trigger housing (4), and a front portion (6) to which are mounted both a foot stirrup (8) for use in cocking the crossbow (1) and a prod, or bow, (10), which is releasably mounted. The stock (2) also has a generally upwardly facing portion (12), the front portion of which serves to support a bolt to be shot from the crossbow (1), and a generally downwardly facing portion (14) that includes both a forward hand grip (16), and a structure (18) for mounting the prod (10).

The prod mounting structure (18) generally comprises a recess (20) in the downwardly facing portion of the stock (14), adjacent the front end thereof (6), with a releasable fastener (22) for releasably affixing the prod (10) to the stock (2), and a pivoting latch structure (24) to capture the prod (10) within the recess (20).

The stock (2) preferably is formed of a rigid material, conveniently either wood or a rigid synthetic resin, although metal or other materials having desired stiffness and weight characteristics may also be used. If the stock (2) is formed from a synthetic resin, it may conveniently be molded as a single unit, or molded in two halves that are joined by a suitable fastening structure. The prod (10) may be formed of conventional materials, such as fiberglass, carbon fiber and resin, metal, or any other suitable material having the desired stiffness and resilience. The foot stirrup (8) typically may be formed of metal, although it could also be formed of a synthetic resin, if desired, and is attached to the forward end (6) of the stock (2) by conventional means.

Figure 3:
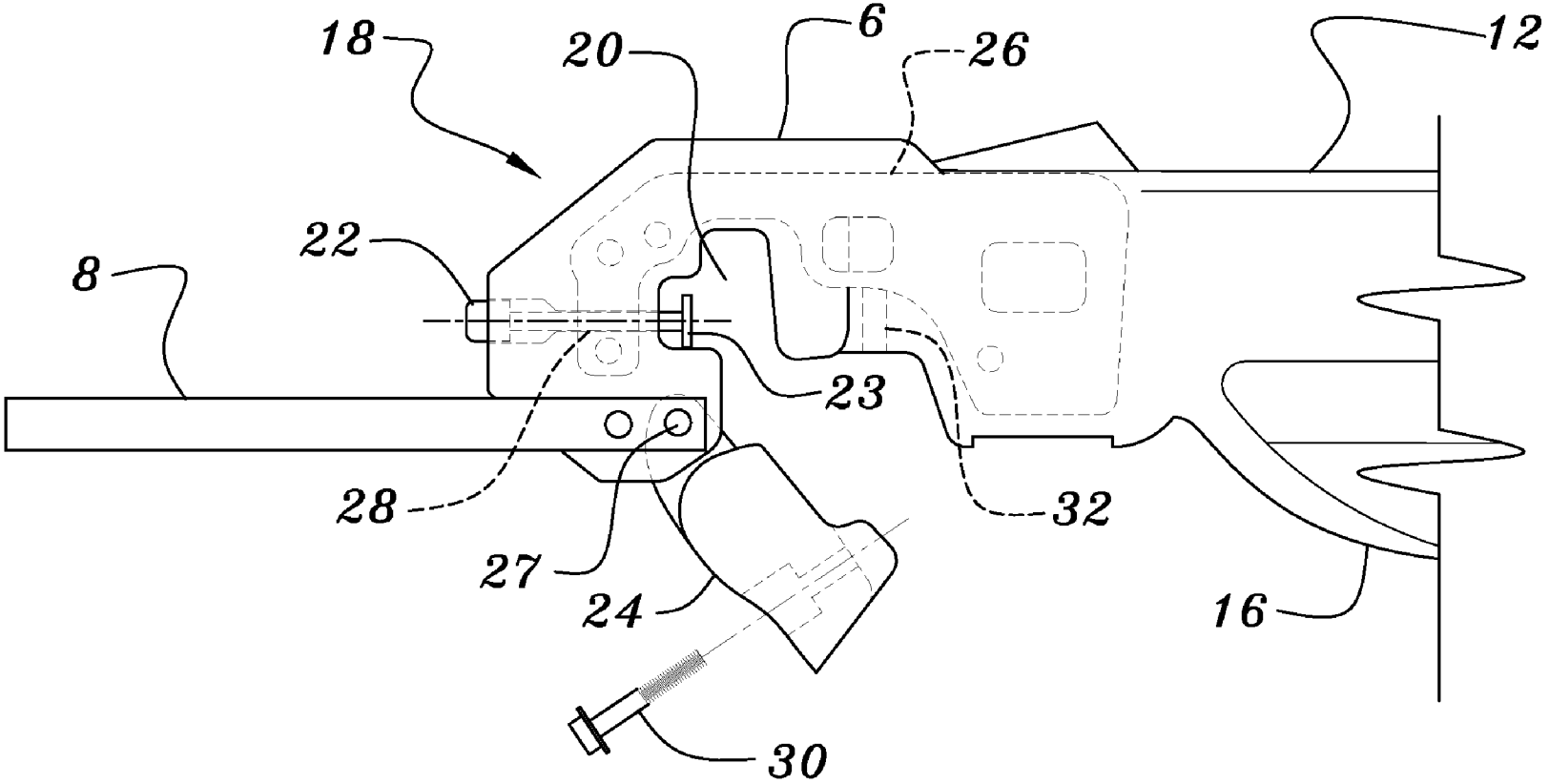
FIG. 3 is a side view, partially in phantom, of the front portion of the crossbow of FIG. 1 with the pivoting latch in the open position.

As shown in the phantom representation of FIG. 3, at least one, and preferably a plurality of reinforcement members (26) are mounted to the stock (2) adjacent the front end (6) thereof to provide additional rigidity and strength. On a wooden stock (10) these reinforcing members (26) may be mounted to the sides of the stock (2), or, in this preferred embodiment, overmolded within the molded synthetic resin stock (2). These reinforcing members (26) are configured to conform generally to the profile of the recess (20) formed adjacent the front end (6) of the stock (2) in the lower portion thereof to provide additional strengthening and support against the forces exerted on the stock (2) by the prod (10) when it is cocked and fired.

The pivoting latch portion (24) may conveniently be formed of the same material as the stock (2) itself, and it is mounted to the stock (2) by a shaft, or bolt, (27), for pivoting movement around the axis of that shaft, or bolt, (27), between a first position capturing the prod (10) to hold the prod (10) in place within the recess (20), and a second position pivoted away from such engagement, to enable removal and remounting of the prod (10).

Figure 2:
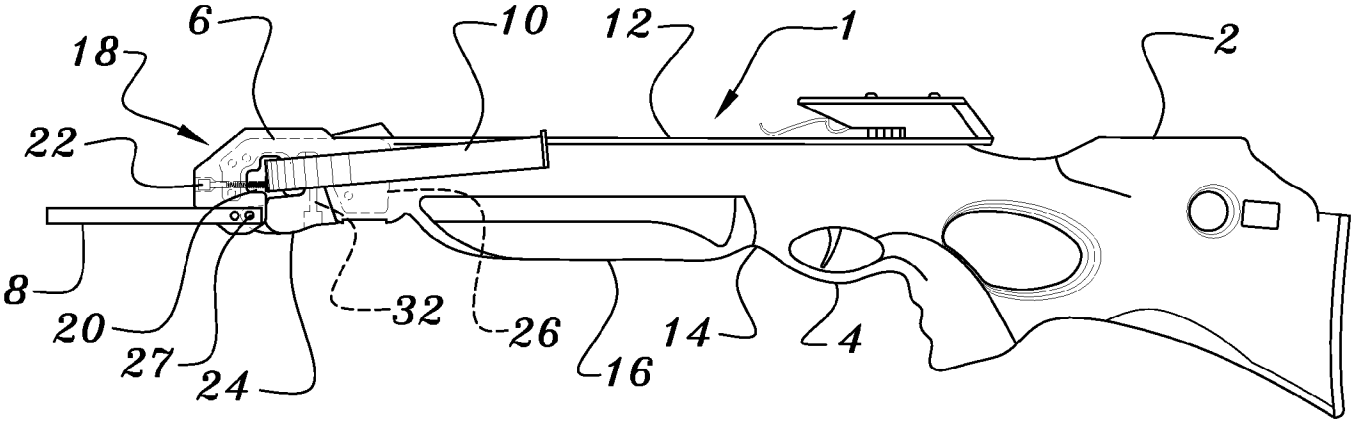
FIG. 2 is a side view of the crossbow of FIG. 1 with the prod mounted to the stock and the pivoting latch in the closed position.
Figure 4:
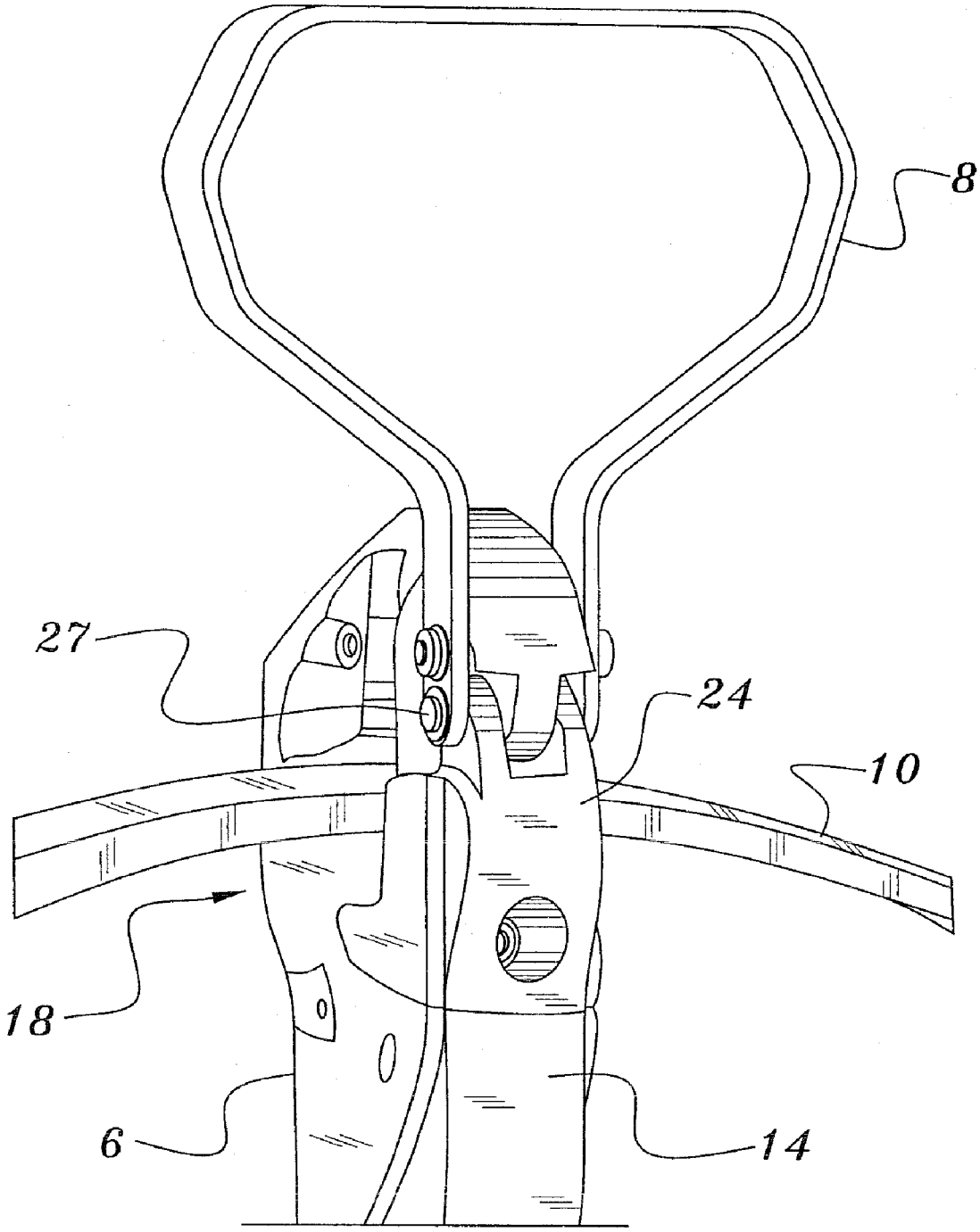
FIG. 4 is a bottom perspective view of the front portion of the crossbow embodiment of FIG. 2.

As shown in FIG. 3, there is mounted to the stock (2), ahead of the recess (20) and generally normal to the forward surface of the mounted prod (10), a fastener (22) for affixing the prod (10) to the stock (2). Preferably, this fastener (22) comprises an internally threaded member (28), which conveniently be a bushing mounted to the stock (2), for receiving a corresponding externally threaded member (22), such as a bolt or cap screw, to be threaded against the prod (10) to hold the prod (10) in place against the rear of the recess (20). Preferably a substantially rigid pad (23) is interposed between the end of the threaded member (22) and the prod (10) to spread the force of the threaded member (22) over a larger area of the prod (10). Thus, when the prod (10) is inserted into the recess (20), the externally threaded member (22) may be threaded against the prod (10) to clamp it in place for use. Subsequently, the pivoting latch portion (24) may be pivoted from the second, open position to the first portion, capturing the prod (10), as shown in FIGS. 2 and 4. In this position, a threaded fastener (30) extending through the latch portion (24) is threaded into a correspondingly internally threaded element (32), such as a nut, that is mounted to the stock (2) directly above the pivoting latch (24). Thus, with the latch fastener (30) threaded into that nut (32), which conveniently may be either self clinching or otherwise captured within the upper portion of the stock (2), the latch portion (24) is held in place in the first position. With this structure, when the crossbow (1) is to be transported, the prod (10) may be removed by releasing the latch fastener (30) holding the latch (24) in place and permitting that latch (24) to pivot downwardly, and then withdrawing the externally threaded member (22) that engages the front surface of the prod (10) and urges it against the rear portion of the recess (20), as shown in FIG. 2. With the release of the member (22) engaging the prod (10), the prod (10) may then be removed out the bottom of the recess (20) and may then be turned approximately 90 degrees so that the strung prod (10) is generally parallel to the stock (2), to facilitate packaging and transporting it in a compact unit.

Similarly, when the transported product is to be used, a reverse procedure is employed, in which the latch portion (24) is opened, the prod (10) is positioned with the string above the stock (2) and the bow portion (10) below and then moved into position within the recess (20). At this point the externally threaded member (22) is threaded against the front of the prod (10) to clamp it in place against the rear of the recess (20), and the latch portion (24) is then pivoted into its closed position, with its fastener (30) being connected to the upper portion of the stock (2), thus holding the latch (24) in its closed position. The crossbow (1) is then ready for use, with the clamping arrangement of the externally threaded member (22) against the front of the prod (10) holding it in place, and the reinforcement members (26) supporting the front end of the stock (6) against the forces exerted as the string is cocked and then released when the bolt is shot.

While the foregoing describes one preferred embodiment of the crossbow of this invention, it is to be understood that this description is to be considered only as illustrative of the principles of the invention and is not to be limitative thereof, as numerous other variations, all within the scope of the invention will readily occur to others.

I claim:

1. A crossbow comprising a stock having a front end and a detachable, pre-strung prod wherein the stock includes a recess proximal to said front end for receiving said pre-strung prod, a releasable fastener for securing said pre-strung prod to said stock, and a latch pivotally attached to said stock adjacent said recess and movable between a first position capturing said pre-strung prod within said recess, and a second position pivoted away from said prod-capturing position to allow detachment and removal of said pre-strung prod from said stock when said latch is in said second position.

2. A crossbow according to claim 1 wherein said releasable fastener for securing said pre-strung prod to said stock comprises an internally threaded member fixedly mounted to said stock, and an externally threaded member threadedly received through said internally threaded member such that one end of said externally threaded member may be threaded against the forward surface of said pre-strung prod captured within said recess, whereby the prod is secured within the recess by the externally threaded member clamping the prod against the rear of the recess.

3. A crossbow according to claim 2 wherein said internally threaded member is fixedly mounted to said stock between said recess and said stock front end and has a central axis generally normal to the front surface of said pre-strung prod received within said recess.

4. A crossbow according to claim 1 wherein said recess is formed in the underside of said stock proximal said stock front end.

5. A crossbow according to claim 1 further comprising at least one reinforcement member fixedly attached to said front end of said stock to support said pre-strung prod.

6. A crossbow according to claim 1 further comprising at least one reinforcement member molded into said front end of said stock to support said pre-strung prod.

7. A crossbow according to claim 1 further comprising a releasable fastener engaging both said latch and said stock for releasably securing said latch in said first position.

8. A crossbow according to claim 7 wherein said latch-securing releasable fastener comprises an externally threaded member extending through said latch, and an internally threaded member fixedly secured to said stock adjacent said latch to receive said externally threaded member.

* * * * *